US008266864B2

(12) United States Patent
Claypool

(10) Patent No.: US 8,266,864 B2
(45) Date of Patent: Sep. 18, 2012

(54) READILY CONFIGURED AND RECONFIGURED STRUCTURAL TRUSSES BASED ON TETRAHEDRONS AS MODULES

(76) Inventor: Joe Pete Claypool, Chatsworth, CA (US)

( * ) Notice: Subject to any disclaimer, the term of this patent is extended or adjusted under 35 U.S.C. 154(b) by 29 days.

(21) Appl. No.: 12/858,600

(22) Filed: Aug. 18, 2010

(65) Prior Publication Data

US 2011/0030306 A1 Feb. 10, 2011

Related U.S. Application Data

(63) Continuation-in-part of application No. 11/827,240, filed on Jul. 11, 2007, now abandoned.

(51) Int. Cl.
*E04H 12/00* (2006.01)

(52) U.S. Cl. ..... 52/652.1; 52/645; 52/646; 52/690

(58) Field of Classification Search ..... 52/69–71, 52/81.2, 81.3, 648.1, 652.1, 637, 641, 646
See application file for complete search history.

(56) References Cited

U.S. PATENT DOCUMENTS

| | | | | |
|---|---|---|---|---|
| 3,783,573 | A | 1/1974 | Vaughan | |
| 4,262,461 | A * | 4/1981 | Johnson et al. | 52/81.3 |
| 4,580,375 | A * | 4/1986 | Nodskov et al. | 52/109 |
| 4,655,022 | A * | 4/1987 | Natori | 52/646 |
| 4,745,725 | A | 5/1988 | Onoda | |
| 5,040,349 | A | 8/1991 | Onoda et al. | |
| 5,125,206 | A | 6/1992 | Motohashi et al. | |
| 5,203,134 | A * | 4/1993 | Sorenson et al. | 52/646 |
| 5,423,341 | A * | 6/1995 | Brady | 135/139 |
| 5,651,228 | A | 7/1997 | Zeigler | |
| 5,701,713 | A * | 12/1997 | Silver | 52/645 |
| 6,076,770 | A * | 6/2000 | Nygren et al. | 244/159.5 |
| 6,618,025 | B2 | 9/2003 | Harless | |
| 8,011,162 | B2 * | 9/2011 | Overby | 52/745.17 |

* cited by examiner

*Primary Examiner* — Brian Glessner
*Assistant Examiner* — Adam Barlow
(74) *Attorney, Agent, or Firm* — James M. Duncan, Esq.; Klein, DeNatale, Goldner, et al.

(57) ABSTRACT

Truss structures assembled from modules comprising one hinge link, four spacer links and four apex joinders, one at each end or each hinge link. The second hinge link to complete a tetrahedron is missing from the module, and is provided by the hinge link of a next in line module so as to provide a series of joined tetrahedrons. When the strut is assembled, the apex joinders enable the strut to be formed into a wide variety of shapes.

11 Claims, 9 Drawing Sheets

READILY CONFIGURED AND RECONFIGURED STRUCTURAL TRUSSES BASED ON TETRAHEDRONS AS MODULES

RELATED APPLICATIONS

This is a continuation-in-part of U.S. application Ser. No. 11/827,240, filed Jul. 11, 2007, to which application this inventor claims domestic priority.

FIELD OF THE INVENTION

Structural trusses useful as support structures which are readily assembled from tetrahedron modules into various configurations, and can readily be reconfigured and dismounted. The modules themselves occupy minimal bulk volume and are nestable, to reduce costs of shipment.

BACKGROUND OF THE INVENTION

Most common structural trusses include in-plane series of rigid three-link modules—rigid triangular elements. Others include combinations of rigid links and cable links. These have in common limitations on the ultimate configuration of the truss, especially when curvatures and twists are involved.

In addition, when they are shipped, they are usually in sections that include a large hollow volume. In effect the user ships a considerable amount of air. When freight is charged by volume rather than weight, the cost to ship them compared to the cost of shipping a group of nested modules is considerable. When shipped by truck, fewer trucks are required to move the elements major structures.

This invention is expected to find its earliest usage in the theatrical field where lights and equipment must be supported in various configurations, which configuration (geometry) must often be changed quickly, for example when moving from a stage of one configuration to one of a different configuration. These systems must often be shipped by air or truck when the production moves to another location, and changed to a different arrangement during the same production.

Versatility of available configuration is another advantage of this invention. Depending on the job, an arch, a complicated curvature (both in-plane and out-of-plane), trussed and straight trusses are available using the same equipment. Even totally circular rings can be formed. Many attainable configurations are not available elsewhere at all, and when available they involve large costs.

It is an object of this invention to provide a truss composed of interconnected modules whose ultimate configuration can readily be calculated and built, and which when dismantled can be shipped economically. It is structurally sound, and economical to make. In use it has versatility of shape, and is able to support auxiliary equipment such as lights and rails.

In addition this invention can provide structures intended to be permanent or to remain in place for a considerable amount of time.

BRIEF DESCRIPTION OF THE INVENTION

This invention provides a module to make a variable geometry truss which can readily be configured and reconfigured, dismounted, and economically shipped. It is based on the tetrahedron which is a stable and rigid structure. The truss is formed by joining contiguous modules at hinge links.

The module itself includes a hinge link, four spacer links, and four apex joinders. A complete tetrahedron would have one more hinge link between apex joinders, but it is "missing" one. This is for the purpose of inserting the hinge link of the "next" module into that open spacing to complete the tetrahedron structurally and to provide for a hinging movement at the junction.

The space left open by the missing link enables a similar module to be nested into its neighbor, thereby greatly reducing the bulk of the modules for shipment.

Auxiliary equipment can be and immediately will be attached to the truss.

The above and other features of this invention will be fully understood from the following detailed description and the accompanying drawings, in which:

BRIEF DESCRIPTION OF THE DRAWINGS

FIG. 1 is a top view of the basic structure of a module according to the invention.

FIG. 2 is a view taken perpendicularly to lines AB in FIG. 1.

FIG. 3 is a top view of FIG. 2.

FIG. 4 is a right-hand side view of FIG. 3.

FIG. 5 is a left-hand side view of FIG. 3.

FIG. 6 is a plan view of a strut according to the invention.

FIG. 7 is a side schematic view showing an angular relationship between two contiguous modules, and their associated sections.

DETAILED DESCRIPTION OF THE INVENTION

This invention utilizes a rigid tetrahedron shape which in its minimum module includes four apexes ("apex joinders" herein), and only five dihedral edges. In contrast, a complete tetrahedron includes six dihedral edges, not just five. The dihedral edges are formed by rigid links which are rigidly joined in groups of three at each of the apex joinders. The omission of one of the links is at the heart of this invention, because in an extended configuration it is provided by the hinge link of a next tetrahedron which thereby forms a hinge joint between two contiguous tetrahedrons, completing the structure.

For convenience in disclosure and recognition, the first group of FIGS. 1-7 is for the purpose of defining the basic structure.

The ultimate objective of this invention is to form a plurality of tetrahedrons at specific nodes ("apex joinders" herein) to provide a hinged-together string of these structures whose ultimate path can be determined by adjusting the angular relationships of contiguous tetrahedrons at axes where the hinge link of one tetrahedron "filled in" for a virtual, missing link of its neighbor. These hinge joinders alternately occur at normally-related skew events.

Figure 1:
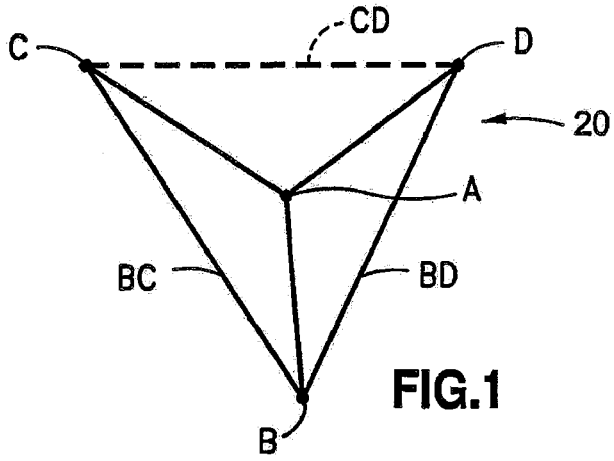
FIG. 1-7 are schematic illustrations of the invention to present the geometric relationship of its parts.

FIG. 1 is a top view of a regular tetrahedron resting on one of its faces. For convenience in disclosure, it and the other Figs. will uniformly use the designations in this FIG. for the disclosure of the invention.

Tetrahedron 20 is formed by six links to provide four dihedral edges and apex joinders. Ultimately, the relationship between axes defined by pairs of apexes will be shown to be critical to the invention.

Apexes A, B, C and D are formed at the rigid intersections of six rigid links. As will be shown, one of these links is missing from each module. In a completed truss, the missing link is supplied by a corresponding link of a next-in-line tetrahedron. The missing link is shown in dashed lines for purposes of this invention.

Figure 2:
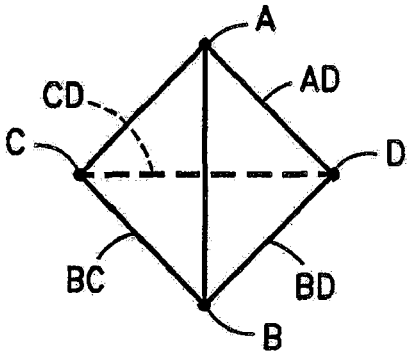

FIG. 2 is supplied to provide a disclosure more useful to the reader. In this Fig, links AB and CD are referred to as "hinge" links.

The links interconnecting the hinge links are called "spacer" links. In the conduct of this invention, the spatial relationship between the hinge links is basic. The function of the spacer links is structurally to hold them in their relative position. A function of all of the links is to provide adequate compression and tension strength for a truss that comprises a hinged-together plurality of these tetrahedrons.

Figure 3:
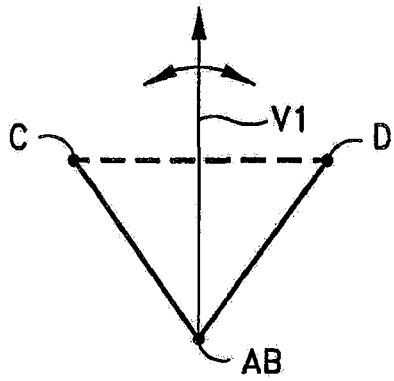
Figure 4:
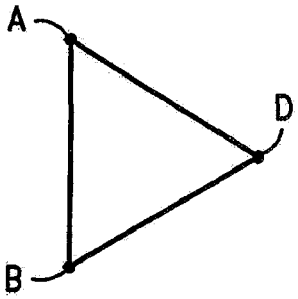
Figure 5:
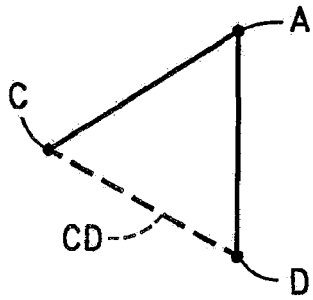

Consider the spatial relationship between hinge links AB and CD. FIG. 2 is an elevation view in which link AB is vertical and in the drawing sheet. It is displayed in solid line. As shown in FIG. 3, which is a top view of FIG. 2, link CD is spaced from link AB. Link CD is shown in dashed line, because the module does not include it. Of most importance is that the axes AB and CD are skew. They are not parallel, but in side view they are normal, but do not meet. CD will be normal to a plane through its mid-point that includes AB. This is of great consequence to this invention, because as shown in FIG. 3 there is a directional vector V, that bisects the dihedral angle. It determines the direction of a strut assembled by the insertion of the link AB of one module into the gap CD of its neighbor.

Further in detail, spacer links AC and AD are a pair structurally joined to apex joinder A. Spacer links BC and BD are a pair joined to apex joinder B. One member of each of these pairs is structurally connected to apex joinder C (spacer links AC and BC), and the other spacer links AD and BD are connected to apex joinder D.

Links AC and BC converge to apex joinder C, and links AD and BD converge to apex joinder D.

The spacing between apex joinders C and D is unobstructed. As will later be shown, these face each other, while apex joinders A and B face away from each other. This enables the parts of the apex joinder to be placed together and enables rotation around this common axis.

The spacing between apex joinders C and D is shown in dashed lines. This spacing is open and unobstructed. It is open to receive hinge links AB from another module, and enable the modules to be nested when not attached to another module.

Figure 6:
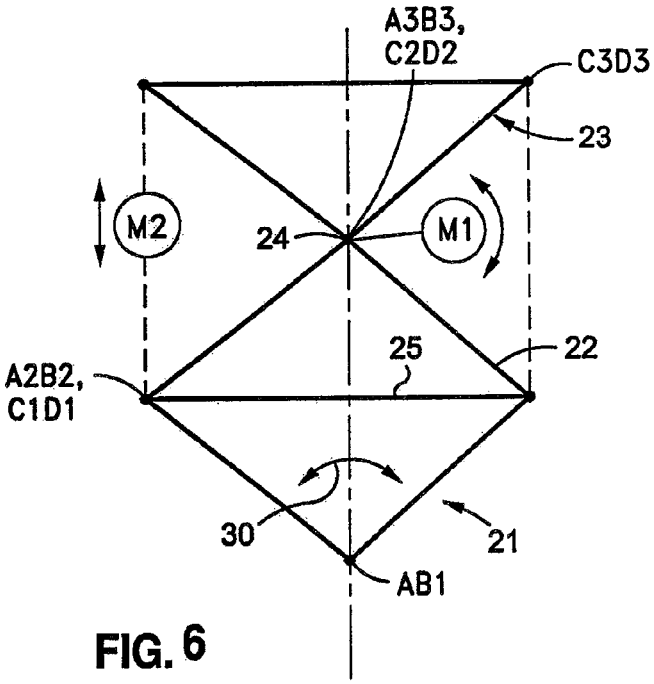
Figure 7:
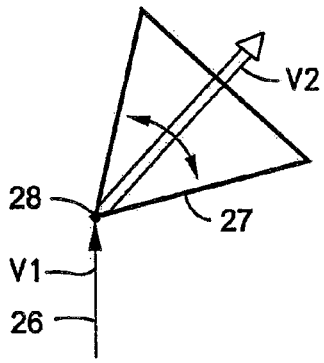
Figure 8:
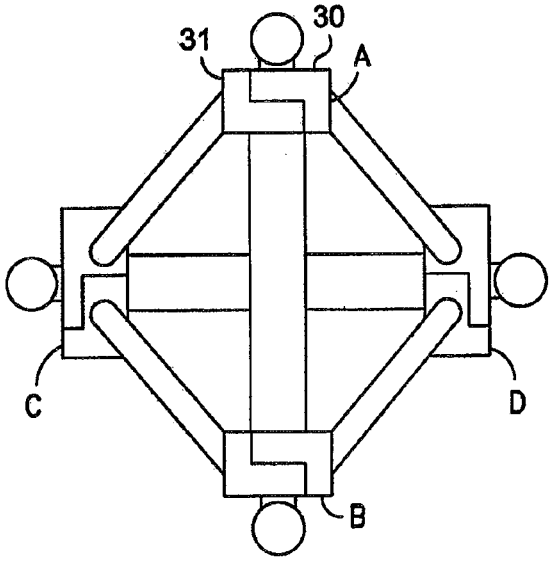
FIG. 8 is a structural view similar to FIG. 2, showing physical as well as geometric features.
Figure 9:
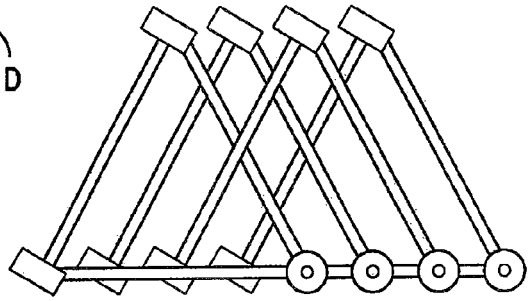
FIG. 9 is a side view showing a group of nested modules.

FIGS. 6 and 7 are schematic showings of joinders of three modules, and the capability of the device to assume a variety of configurations. In FIG. 6, three modules 21, 22, 23, are joined at hinge joints 24 and 25. The letter identifications in FIGS. 1-5 are continued for convenience. The successive links with the same letter also bear a number identifying them as being part of modules 21, 22 and 23.

Here, notice that A1B1 and A3B3 are normal the plane in this view, and that A1B1 and A3B3 are parallel to each other. A2B2 (C1D1) and C3D3 are parallel and in the plane of the view. This is an alternating feature where the illustrated faces of the tetrahedron all lie in the same plane. As will be shown, this relationship can be changed to provide for different shapes, including twists. FIG. 7 illustrates how this can be done.

A first module 26 is hinged to a second module 27 at hinge 28 it's vector V, being shown. The second module has been hinged so its vector V2 extends at a new angle. Vector V2 is unique to its own module, so that its own orientation in space is determined by the placement of the module ahead of it. It is the function of this invention to place each of the modules relationship to its neighbors to direct the total structure at its own position in the sequence. The first hinge link is mounted to supporting structure (not shown) to establish an origin for the struts.

The cross-wise relationship between hinge links AB and CD, provides the facility to direct these structures as disclosed. Even though they do not intersect, rotation around these axes provides the ability to direct the vector of a combination of two of them into any direction within the "field" of the vector, to provide various shapes sinuous, twisting circular and straight as desired.

For example, in FIG. 6, axis AB1 enables the module 21 to swing in "azimuth" from side to side as shown by arrow 30. Adjustment in "elevation" is attained by pivoting module 22 around axis A2B2. Then the vector from module 22 is determined by the initial position of axis AB1, and the position of module 22 around axis A2B2. The combination of azimuth and elevation adjustment available at each pair of modules enables the structure to be directed as desired in its field. This is similar to, but not identical to artillery concepts. The cross-wise axes in this invention do not intersect, but it is equivalent to artillery concepts for the purposes of this invention.

As will be shown, the bearing structures at the apex joinders cannot only be set manually in an adjusted position, but adjustment can be provided by any suitable rotary motor M1 at the bearing structure, or by a linear motor M2 between appropriate apex joinders (FIG. 6). In this later arrangement, a cable or turnbuckle can be used to hold an adjusted position, all as schematically shown.

Figure 14:
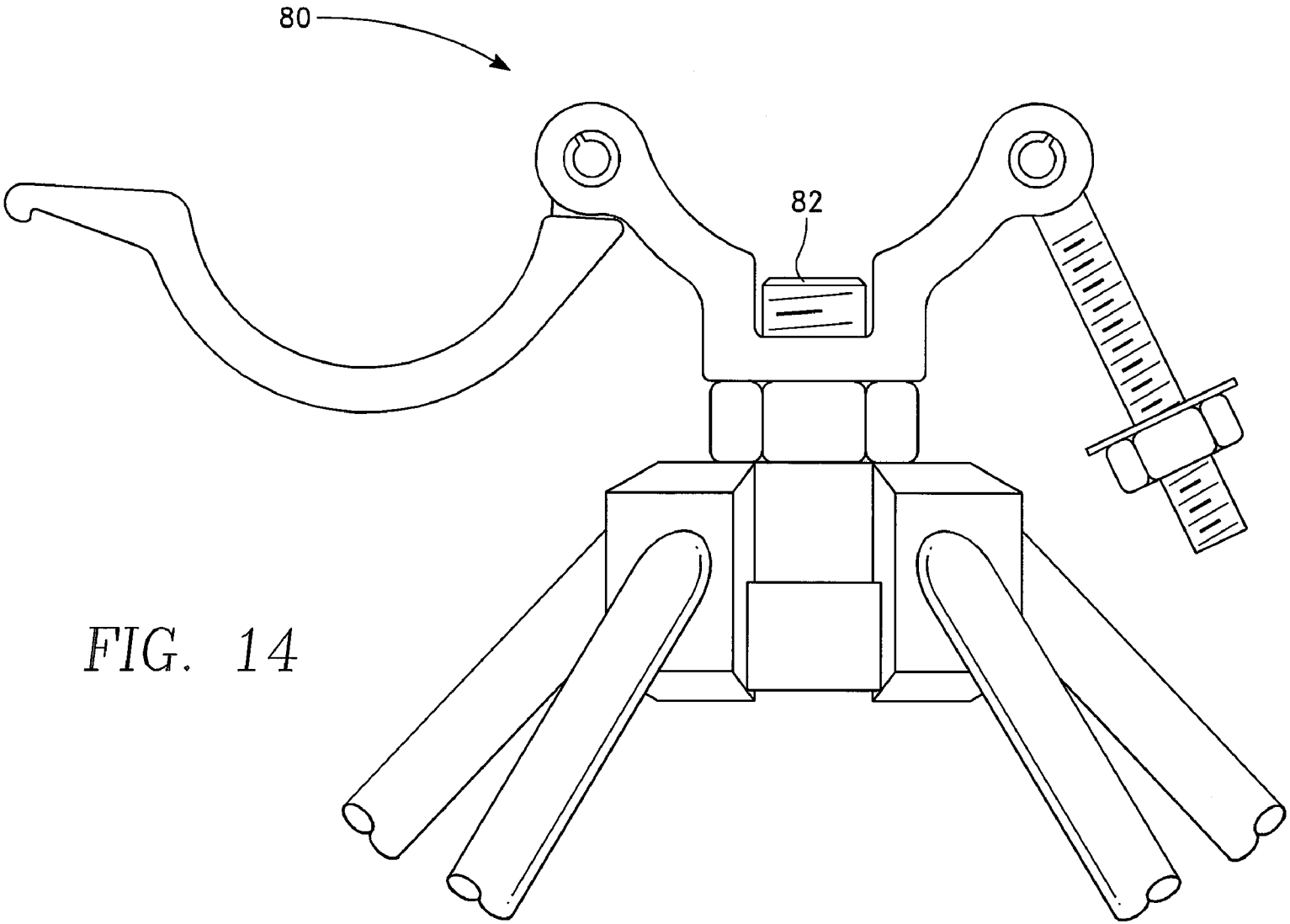
FIG. 14 shows how a chord member attachment bracket may be attached to a node.
Figure 15:
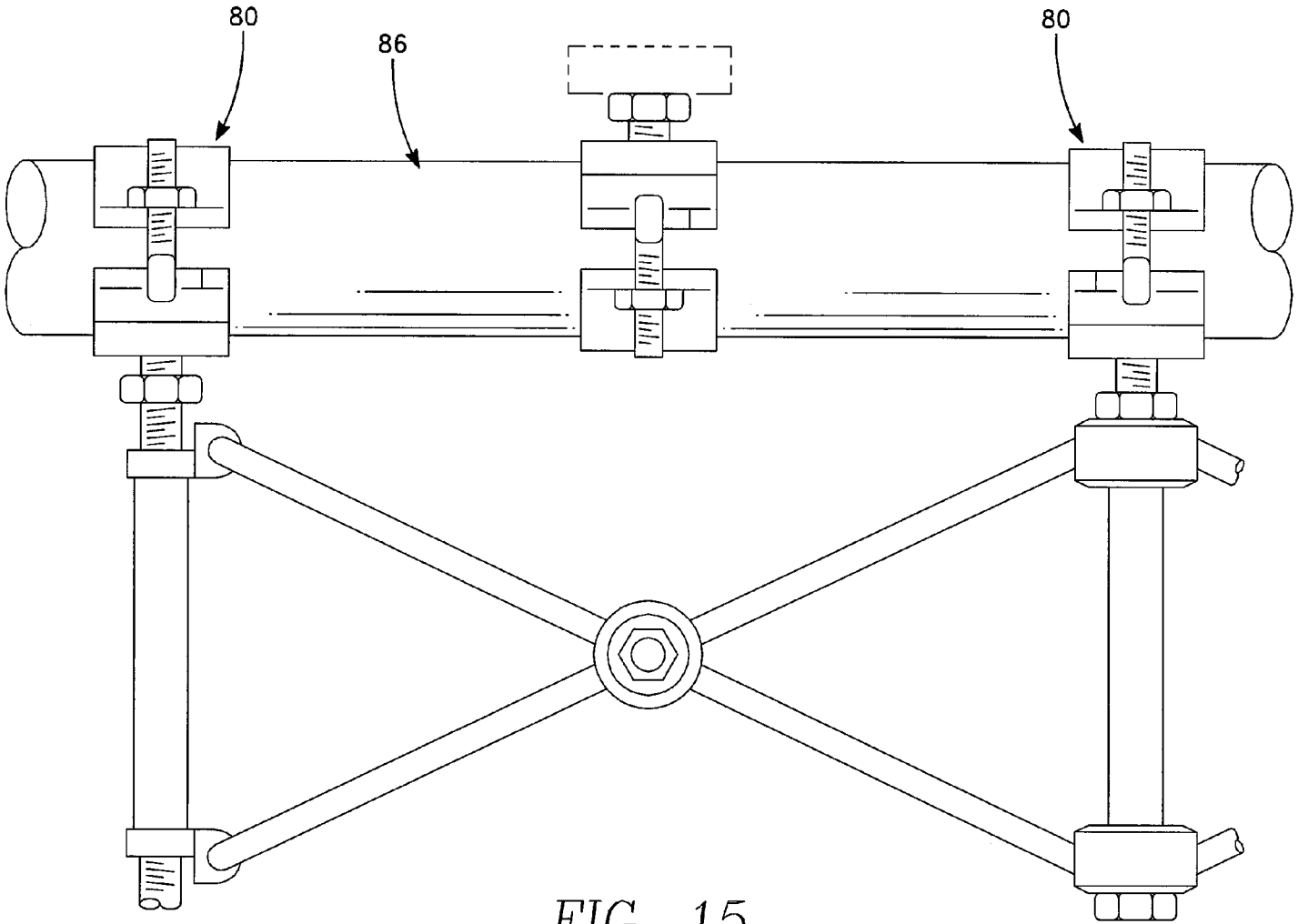
FIG. 15 shows how a chord member may be attached between adjacent nodes.

Frequently auxiliary equipment (not shown), such as lights or rails will be attached to the truss, perhaps using a clamp or other attachment devices at the apex joinders (nodes). In addition, as shown in FIG. 14, a cord member attachment bracket 80 may be attached to one of the nodes of a module using a fastener 82. Fastener 82 may be made up into a threaded aperture 84 in node hinge 100. As shown in FIG. 14, the cord member attachment bracket 80 may comprise a pivoting enclosure member which may be closed with a nut-fastener combination. As shown in FIG. 15, a truss structure configured with a plurality of the disclosed modules may comprise attachment brackets 80 attached to laterally adjacent apex joinders, and a cord member 84 may be secured within the cord member attachment brackets. As further shown in FIG. 15, this feature allows the suspension of a complete truss structure from an adjacent structural member 86 as shown in FIG. 15, which provides great utility in utilizing embodiments of the invention for suspension of lights, speakers, or similar apparatus.

The bearing structure at the apex joinders is formed in two complementary shapes. Each joinder is provided with two of each shape, so disposed and arranged that the hinge link AB of one will fit and engage to hinge link CD of its neighbor.

Figure 10:
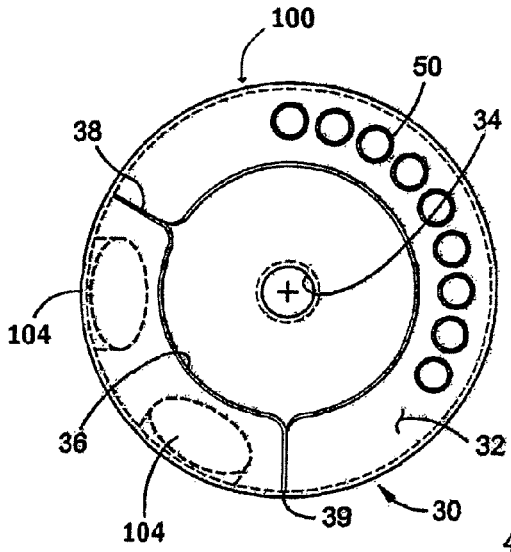
FIG. 10 is a plan view of one part of a programmable node hinge which may be utilized in an embodiment of the invention.
Figure 11:
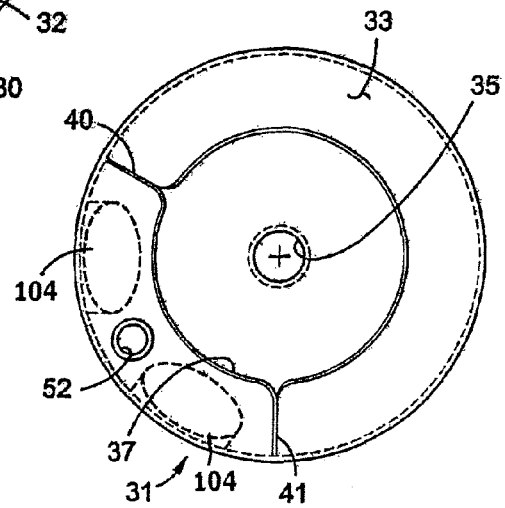
FIG. 11 is a plan view of a nesting part of the programmable node hinge which cooperatively engages the part shown in FIG. 10.
Figure 12:
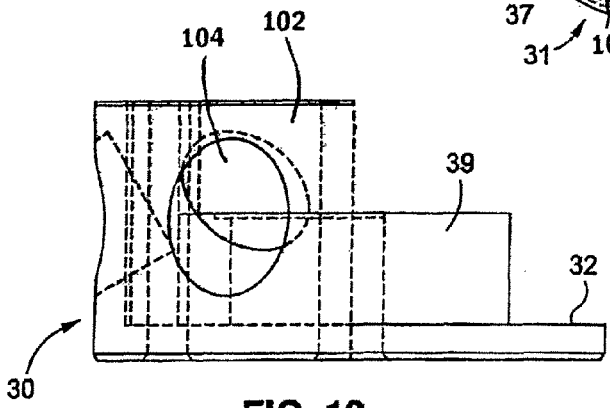
FIG. 12 is a side view of the part of the programmable node hinge shown in FIG. 10.

FIG. 10 is a plan view of a programmable node hinge 100 which may be utilized to facilitate construction of various truss combinations by allowing the angle between adjacent spacer links to be easily adjusted. Programmable node hinge 100 is one embodiment of an apex joinder, as shown in greater detail in FIG. 13. Programmable node hinge 100 comprises a radial surface 102. Radial surface 102 comprises a plurality of apertures 104 as best shown in FIGS. 10 and 11. As shown in FIGS. 10 and 11, bearing structures 30, 31 are complementary. Each includes a bearing face 32, 33, a central fastener or axial passage 34, 35, and in the preferred embodiment an accurate stop 36, 37, having a pair of shoulders 38, 39 and 40, 41 which engage at the limits of permitted rotatability. They rotate in the same place. Each is fixed to adjacent structures. When they meet in abutment the stop the rotation. The permitted rotatability is the difference between 360 degrees and the total arcs of the steps. In the illustration, each step is 120 degrees. The permitted rotation is 120 degrees. If desired, indexing holes 50 can be provided to pass a pin through one point of the bearing structure into a hole 52 in the other so as readily to establish the angle between the module at same established values, thus facilitating construction of various truss structures.

Figure 13:
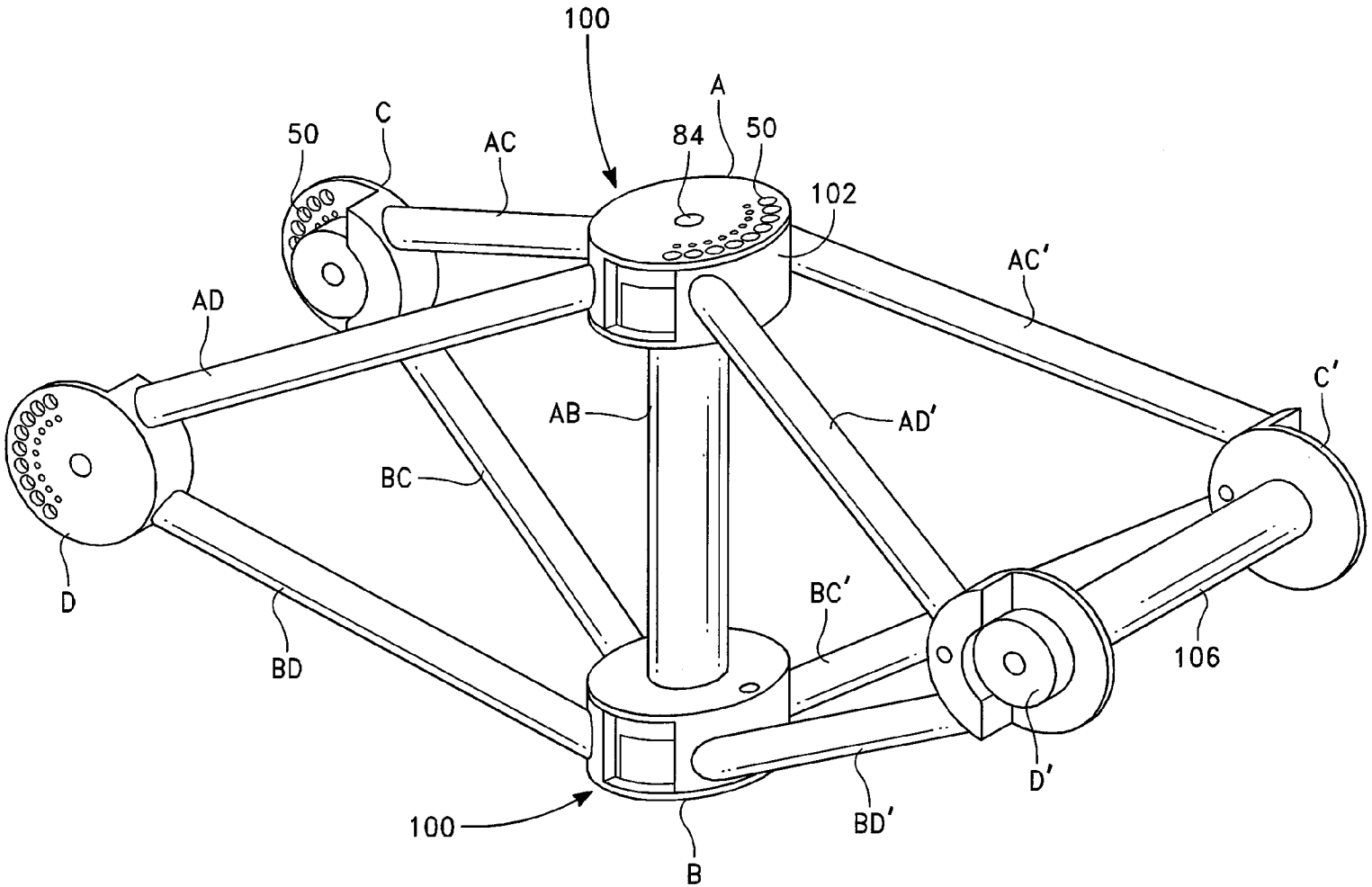
FIG. 13 is a perspective view of a module configured with the disclosed programmable node hinge.

The two complementary apex joinders can readily be placed together, and held together by fastener means that enable relative rotation, for example a headed bolt and nut. In use, after placing the hinge link of the first module, usually on a mount that enables the module to rotate around it, the vector of the first module is established. Then the next module is attached—in links AB in the link of the first module, and its vector is established. This sequence continues for any number, usually three or more, until the truss is completed. The apex joinders are tightened down at each step. FIG. 13 shows the connection of two modules connected together with hinge link AB. As shown in FIG. 13, a third module may be easily connected into the gap CD. Gap C'D' of FIG. 13 shows a sleeve 106 disposed into the gap C'D'. A module may be attached by insertion of a fastener into sleeve 106. As further shown in FIG. 13, the apex joinders may comprise programmable node hinges 100, or portions thereof, thereby facilitating the construction of various truss structures.

The relative orientation of successive modules can readily be calculated, so that the parts when delivered can be accompanied by instructions for assembly, and may be color coded to further facilitate construction.

When all of the links have the same length, the module will (when completed) be a regular tetrahedron with all of its faces equilateral triangles. This is the most convenient and recommended situation. However, if the lengths of the spacer links are equal, but longer or shorter than the hinge link, the side faces will be isosceles rather than equilateral. This will still function and is within the scope of this invention.

Figure 16:
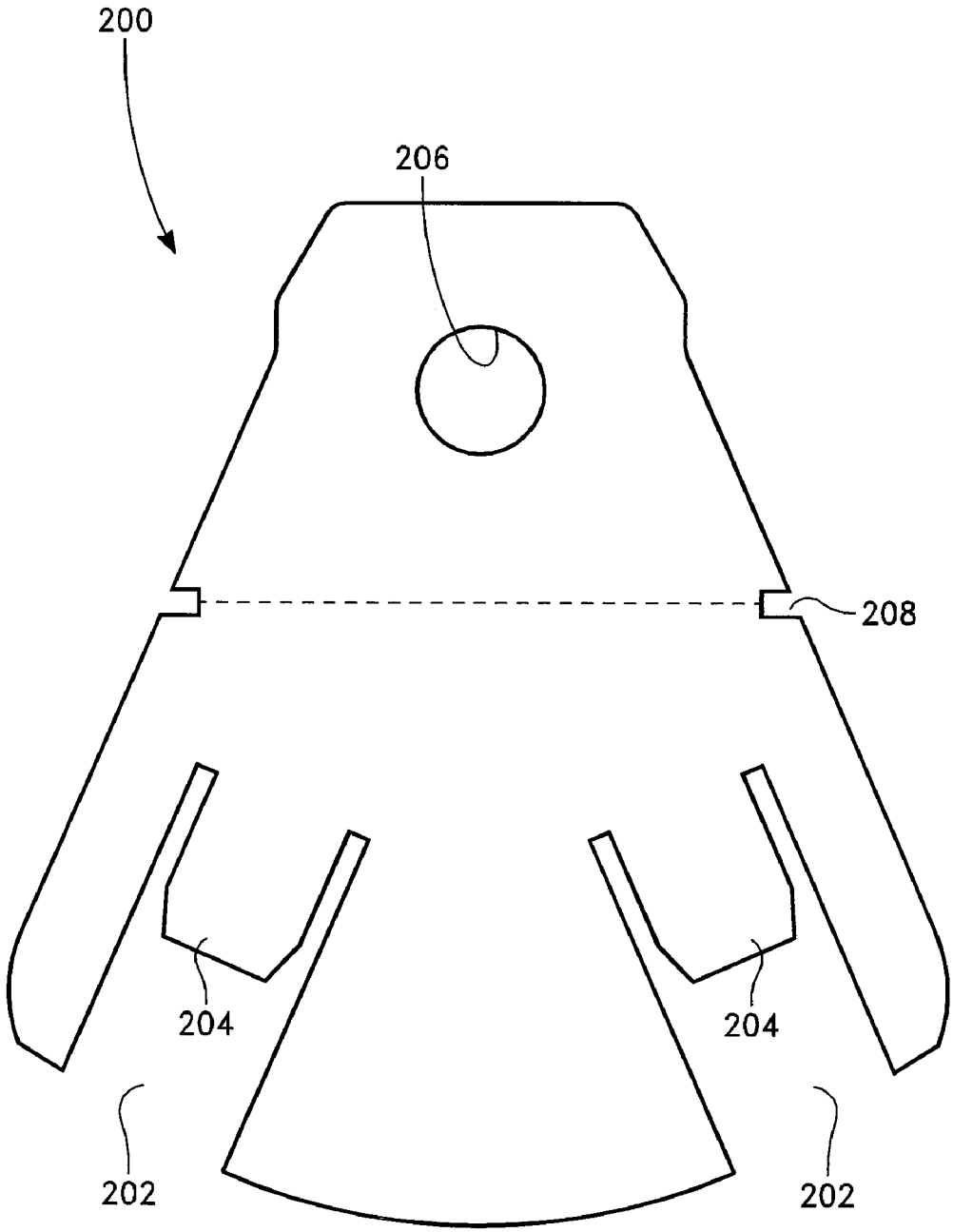
FIG. 16 shows an alternative embodiment of an apex joinder.
Figure 17:
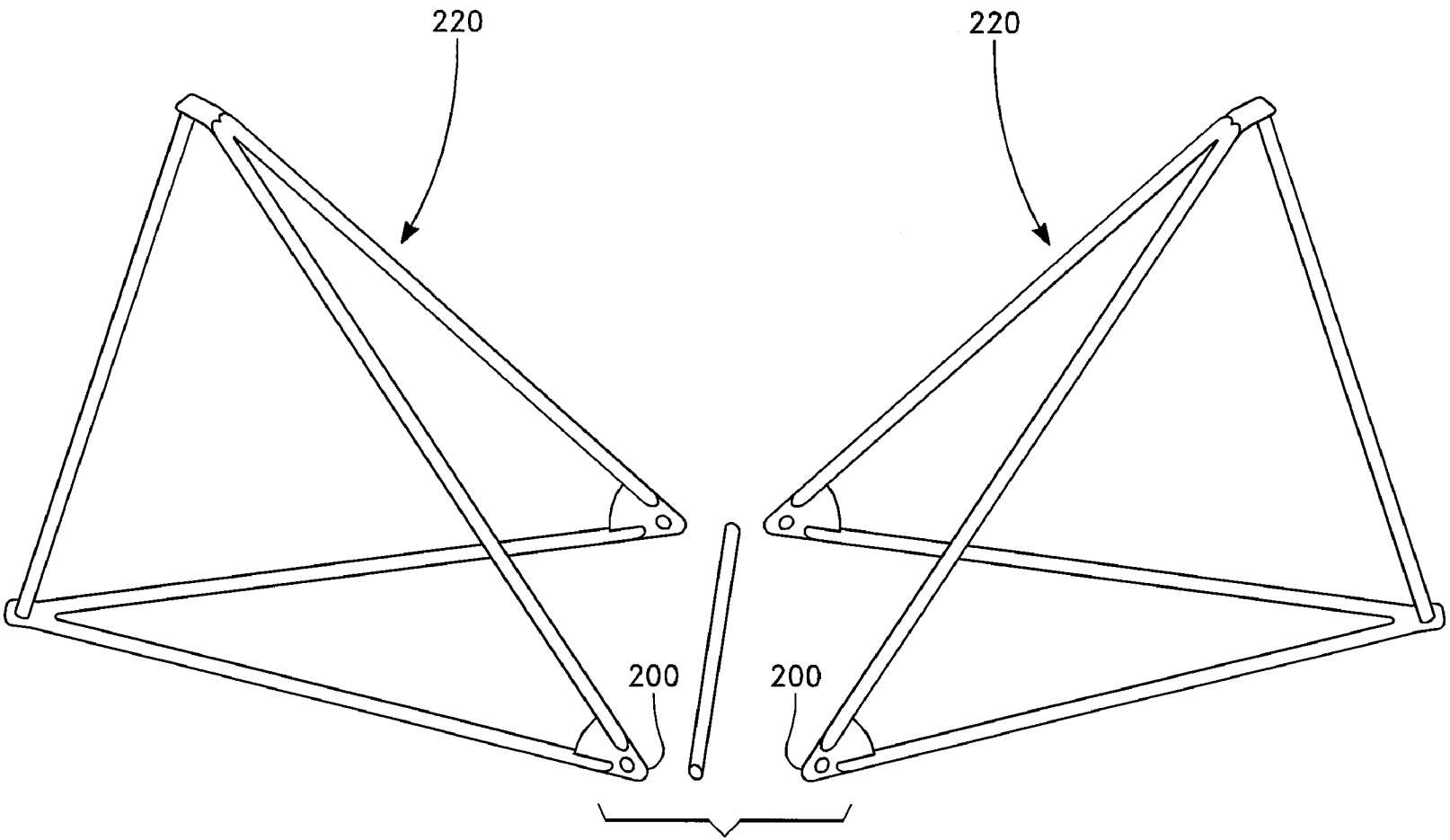
FIG. 17 shows two modules formed with the apex joinders of FIG. 16.
Figure 18:
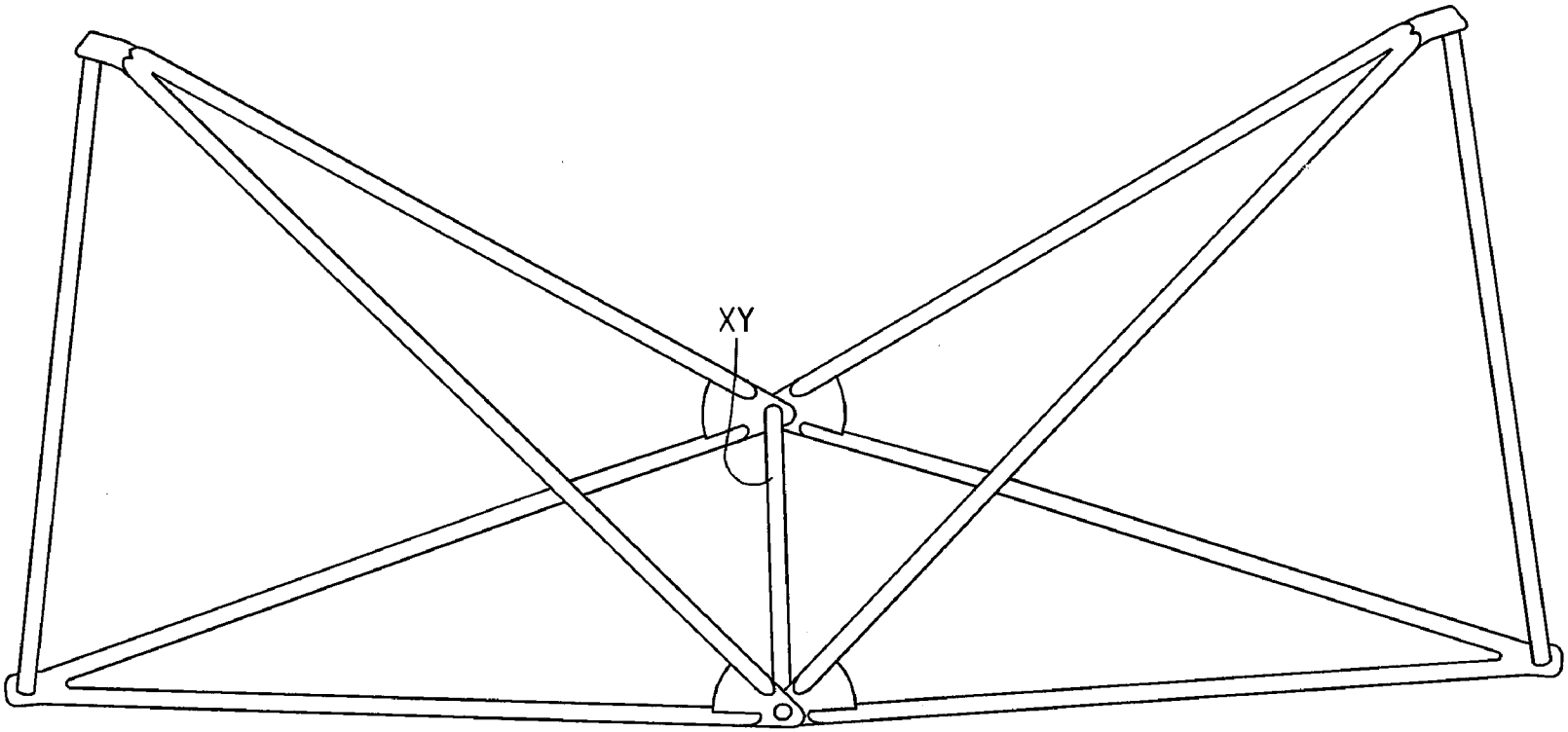
FIG. 18 shows the modules of FIG. 17 joined together.

FIG. 16 shows an alternative embodiment of an apex joinder 200, which may be fabricated from flat material to form a flat hub. Apex joinder 200 comprises registration notches 202 and tangs 204 to which spacer links may be attached by either interference fit or welding. Hinge links are attached between opposing apex joinders 200 by insertion of an end of the hinge link into aperture 206. Apex joinders 200 further comprise a bending line 208 at which point the apex joinder is bent according to the desired angles between the hinge link and the spacer links. Modules 220 comprising apex joinders 200 are shown in FIG. 17. FIG. 18 shows the modules connected together by insertion of a pin, which forms hinge link XY. As shown in FIG. 18, the modules are joined together by overlapping of the apex joinders 200 at each module such that the apertures of the adjoining apex joinders are aligned with one another.

The device can be made of any size and strength. Usually the links will be aluminum alloy tubings of appropriate diameter and wall thickness. The nodes are usually machined or cast metal.

This invention is not to be limited by the embodiments shown in the drawings and described in the description, which are given by way of example and not of limitation, but only in accordance with the scope of the appended claims.

I claim:

1. A module for joining into a sequence of complementary said modules to form a truss of selectable configuration, said module comprising:

a rigid hinge link;

a first and a second apex joinder at a respective first and second end of said hinge link, the first apex joinder and second apex joinder respectively comprising a first radial surface and a second radial surface, the first radial surface and the second radial surface each comprising a plurality of apertures;

four rigid spacer links, a first pair of said spacer links being rigidly attached to said first apex joinder by the insertion of an end of each link into an aperture of the first radial surface, and the second pair of said spacer links being rigidly attached to said second apex joinder by the insertion of an end of each link into an aperture of the second radial surface;

a third and a fourth apex joinder, one spacer link of said first pair and one spacer link from said second pair extending from respective first and second apex joinders to converge on and be rigidly attached to said third apex joinder;

the other spacer links of said first and second pair extending from respective first and second apex joinders to converge on and be rigidly attached to said fourth apex joinder;

all of said apex joinders having a respective central axis of hinge rotation, the axes of said first and second apex joinders being coincident on a first rotation axis and the axes of said third and fourth apex joinders being coincident on a second rotation axis;

said first and second rotation axes being skew to one another, and normal to each other in a plane that includes the mid-point of said hinge link and the said second rotation axis;

there being an unobstructed spacing between said third and fourth apex joinders for reception, engagement and rotation relative to a second module with a similar hinge link, said first and second apex joinders facing axially away from each other, and said third and fourth apex joinders facing axially toward one another; and each of said apex joinders comprising a bearing structure in which said bearing structure includes means to limit the extent of available rotation of a complementary bearing structure.

2. A module according to claim 1 in which the lengths of all of said links measured between their respective apex joinders are equal.

3. A module according to claim 1 in which the lengths of all of said spacer links are equal.

4. A module according to claim 1 in which the said part of the bearing structure of the first and second apex joinders is complementary to the said part of the bearing structure third and fourth apex joinders, whereby the first and second apex joinders of another similar module will be received by the third and fourth apex joinders of this module to form a pair of joined-together modules.

5. In combination:

a first and a second module according to claim 1;

said hinge link of said second module fitting into said spacing between said third and forth apex joinders of said first module, with the respective apex joinders joined for rotation around the rotation axis of said first module;

wherein the means for limiting the extent of available rotation of the complementary bearing structures comprises a shoulder on each bearing structure.

6. A combination according to claim 5 in which indexing means is provided to hold the modules angularly relative to one another at a pre-selected angle.

7. A truss comprising a combination according to claim 5, further including a structural mount to support and retain the hinge link of the first module.

8. A truss according to claim 5 in which attachment means is provided by at least one of said apex joinders for attachment of objects to said truss.

9. A truss according to claim 8 wherein said attachments means comprises a cord member attachment bracket.

10. A truss according to claim 9 wherein two or more laterally adjacent apex joinders each comprises a cord member attachment bracket.

11. A trust according to claim 10 wherein a cord member is disposed between two laterally adjacent cord member attachment brackets.

* * * * *